United States Patent [19]

Wieland

[11] Patent Number: 4,510,760

[45] Date of Patent: Apr. 16, 1985

[54] COMPACT INTEGRATED GAS PHASE SEPARATOR AND SUBCOOLER AND PROCESS

[75] Inventor: Rolf H. Wieland, Norristown, Pa.

[73] Assignee: Messer Griesheim Industries, Inc., Valley Forge, Pa.

[21] Appl. No.: 585,523

[22] Filed: Mar. 2, 1984

[51] Int. Cl.[3] ..... F17C 13/02

[52] U.S. Cl. ..... 62/49; 62/51; 62/55; 137/398

[58] Field of Search ..... 62/45, 49, 51, 55; 137/395, 398

[56] References Cited

U.S. PATENT DOCUMENTS

| | | | |
|---|---|---|---|
| 2,772,545 | 12/1956 | Shanley | 62/49 |
| 3,144,200 | 8/1964 | Taylor et al. | 62/55 |
| 3,296,809 | 1/1967 | Feuerstein | 62/45 |
| 3,360,947 | 1/1968 | Fretwell et al. | 62/45 |
| 3,422,632 | 1/1969 | Currie et al. | 62/45 |
| 3,455,117 | 7/1969 | Prelowski | 62/45 |
| 3,729,946 | 5/1973 | Massey | 62/51 |
| 3,913,340 | 10/1975 | Hurley | 62/45 |
| 4,203,299 | 5/1980 | Dinglinger | 62/49 |
| 4,279,626 | 7/1981 | Buchmüller et al. | 62/55 |

*Primary Examiner*—Ronald C. Capossela

*Attorney, Agent, or Firm*—John F. A. Earley; John F. A. Earley, III

[57] ABSTRACT

A compact integrated gas phase separator and subcooler for removing gas phases from a liquid gas and subcooling the liquid gas comprises a subcooler with a subcooler container having a subcooled bath of liquid gas, a gas phase separator having a container submerged in the subcooler bath, a tube for delivering liquid gas from a supply line into the gas phase separator, a coil extending from the gas phase separator for delivering the liquid through the subcooler bath to subcool the liquid and deliver it to an outlet tube to the supply lines. A takeoff tube and float valve delivers gas and liquid from the separator to the subcooler, and the heat from the coil vaporizes some of the liquid in the subcooler to reduce the level of the bath and to operate the float valve to deliver the gas from the separator to the subcooler and to replenish the level of the liquid in the subcooler by delivering liquid to it from the separator.

8 Claims, 1 Drawing Figure

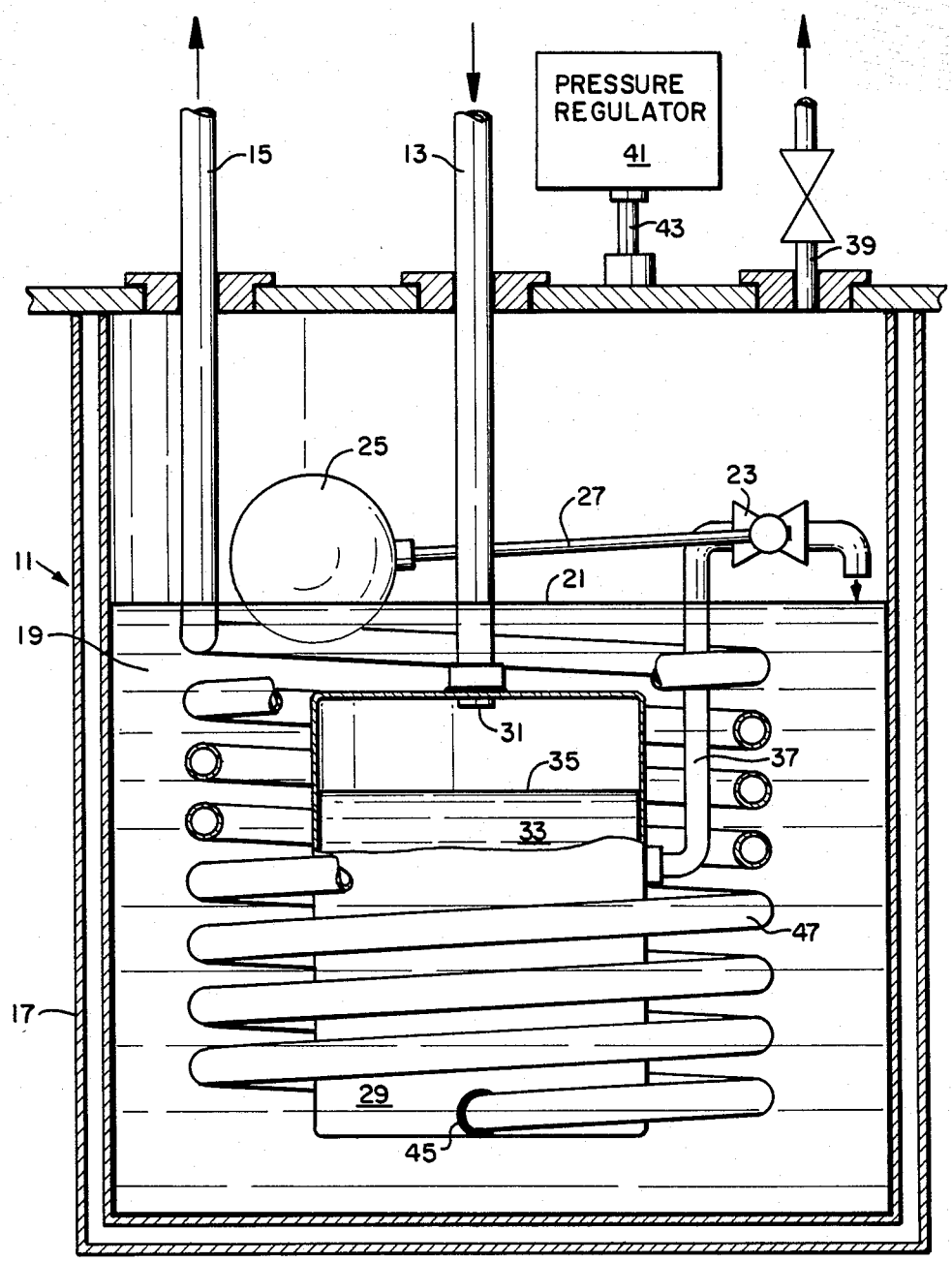
PRESSURE
REGULATOR
41
15
13
43
39
25
23
27
11
21
19
31
35
37
33
47
17
29
45

COMPACT INTEGRATED GAS PHASE SEPARATOR AND SUBCOOLER AND PROCESS

BACKGROUND OF THE INVENTION

This invention relates to a process and apparatus for delivering liquid gas to a use point, and more particularly concerns a process and apparatus for removing gas phases from the liquid gas and subcooling the liquid.

There is a problem in delivering liquid gas from its pressurized storage container to the point where it is to be used because there are heat leaks in the delivery line between the storage container and the machine where the liquid gas is to be used, especially if the delivery lines are long. These heat leaks vaporize a portion of the liquid gas into a gas phase, and the gas phase must be separated from the liquid.

SUMMARY OF THE INVENTION

It is an object of this invention to remove the gas phases from the liquid gas and leave only liquid which is delivered to the use machine.

It is another object to reduce the amount of gas phases produced by heat leaks in the delivery lines by reducing the temperature of the gas so that it withstands a greater amount of heat before it vaporizes.

It is another object to provide a compact integrated gas phase separator and subcooler which accomplishes these objects.

The inventive apparatus comprises a subcooler having a bath of cold liquid gas, a gas phase separator submerged in the subcooler bath, a copper coil which transports liquid from the gas phase separator through the subcooler cold bath to reduce the temperature of the liquid gas in the coil and return it to the supply lines, and a float valve control mechanism for controlling the level of liquid in the subcooler bath and in the separator bath.

The inventive process includes the steps of separating out the gas phases of the liquid gas, cooling the liquid by passing it through a cold bath in the subcooler and returning it to the supply lines, removing the gas phases from the apparatus, actuating the gas relief valve to remove gas from the separator by heating the cold bath in the subcooler to lower the level of the subcooler bath, and replenishing the level of the liquid in the subcooler bath by transferring liquid to it from the separator bath after a certain amount of gas has been removed from the separator.

BRIEF DESCRIPTION OF THE DRAWINGS

The FIGURE is a schematic drawing showing a compact integrated gas phase separator and subcooler constructed in accordance with this invention.

DETAILED DESCRIPTION OF THE INVENTION

Turning to the drawings, there is shown a compact integrated gas phase separator and subcooler 11 for removing gas phases from a liquid gas and subcooling the liquid gas which is delivered to the separator-subcooler 11 through a delivery line that is connected with an inlet tube 13 and is gas-phase separated and subcooled and delivered to a delivery line through an outlet tube 15.

The subcooler includes a container 17 that is vacuum insulated to prevent heat leaks. The outside of container

17 does not get too cold, and the insulation prevents the cold inside the container from leaking to the outside.

A cold bath 19 of liquid gas is maintained inside container 17, and may be an ambient bath of liquid nitrogen at −320° F. and ambient pressure of 14.7 psi.

Subcooler bath 19 is maintained at a level 21 by a float valve 23 having a float 25 attached to valve 23 by an arm 27.

The gas phase separator includes a container 29 which is positioned inside subcooler container 17 and sits in the cold subcooler bath 19.

Inlet tube 13 passes a liquid gas from a liquid gas supply line into the phase separator container 29 through a port 31 into a separator liquid bath 33 which is maintained at a liquid level 35 by the position of a takeoff tube 37.

Gas phases separated out of the separator liquid bath 33 are delivered from the separator container 29 through takeoff tube 37 to the float valve 23 from where they are deposited into the upper portion of subcooler container 17 above subcooler bath liquid level 21. From there the vapor may be exhausted to atmosphere through a vapor vent 39 formed in the top of subcooler container 17.

Alternatively, vapor vent 39 may be closed, and the vapor may be delivered to a pressure regulator 41 through tube 43. Instead of the ambient pressure provided by vapor vent 39 in subcooler container 17, if vent 39 is closed, pressure regulator 41 may regulate the pressure in the subcooler container 17 to raise or lower the pressure above or below ambient to thereby regulate the temperature of the liquid gas of the subcooler bath 19.

The liquid in separator bath 33 is passed from the separator out through a port 45 in the bottom of the separator container 29 into copper coils 47 where heat is exchanged in order to subcool the liquid gas contained in the coils and deliver it to outlet pipe 15 at a desired temperature and pressure. For example, for liquid nitrogen, the liquid nitrogen may come into the subcooler-separator 11 through inlet tube 13 at −289° F. at 60 psi and may be delivered to outlet tube 15 at −320° F. at 60 psi.

The heat from coils 47 heats the liquid in subcooler bath 19 and vaporizes some of it so as to reduce the level 21 of the bath and thereby operate float valve 23 to open it and deliver gas from the top portion of separator container 29. When all the gas is delivered from the top portion of separator container 29 and the level of the separator liquid 33 reaches takeoff tube 37, liquid from the separator is delivered to float valve 23 into subcooler container 17 and raises the liquid level 21 to raise float 25 and shut off float valve 23.

Subcooler-separator 11 is adapted for use with cryogenic fluids other than liquid nitrogen, which is used here to illustrate the invention.

Subcooler-separator 11 is compact in size and enables the user to install the unit on or near the equipment which is to use the subcooled liquid gas.

The liquid in separator container 29 is the use liquid which is to be treated in the separator and in the subcooler and returned to the supply lines through outlet tube 15.

The process for removing gas phases from a liquid gas and subcooling the liquid gas comprises the steps of passing a liquid gas from a supply line into a bath 33 of liquid gas in a gas phase separator container 29, separating out the gas phases and collecting the gas phases in the top portion of separator container 29, and passing the liquid to the bottom portion of subcooler container 17, subcooling the liquid gas by passing it from the bottom portion of separator container 29 through a port 45 and into heat exchanger coils 47 which extend from the separator container 29 to a subcooler bath 19 of liquid gas in subcooler container 17, delivering the subcooled liquid gas from the heat exchanger coils 47 and the subcooler container 17 to a supply line through a delivery or outlet tube 15, passing the gas phases from the separator container 29 into the top portion of the subcooler container 17 through a float valve 23, opening float valve 23 by lowering the level 21 of the liquid gas 19 in the subcooler container 17 by heating the subcooler liquid 19 and evaporating some of it, heating and evaporating some of the subcooler liquid gas 19 by applying heat from the liquid gas being subcooled in the coils 47, closing the float valve 23 by replenishing the subcooler liquid gas 19 by passing liquid gas into bath 19 from the separator container 29 through float valve 23 and takeoff tube 37, and passing the gas phases out of the subcooler container 17 through vapor vent 39.

Alternatively, instead of passing the vapor out of vapor vent 39, it may be passed to pressure regulator 41 through tube 43. Pressure regulator 41 may be used to raise the temperature of ambient bath 19 by raising the pressure in bath 19 above ambient, or it may be used to further cool the bath 19 by reducing the pressure in subcooler container 17 to below ambient.

In one example of the inventive process, the liquid gas is liquid nitrogen which is passed into the gas phase separator at a temperature of about −289° F. at 60 psi, and is subcooled in subcooler-separator 11 and delivered to the supply lines through outlet tube 15 at about −320° F. at 60 psi.

Besides liquid nitrogen, liquefied gases which may be treated by subcooler-separator 11 include oxygen, helium, hydrogen, liquiefied petroleum gases, liquefied natural gases, and so on.

The liquid gas delivered from subcooler-separator 11 has had the gas phase removed from it and has been subcooled so that it is better able to withstand heat and does not start to vaporize, in the case of nitrogen, until it reaches a temperature of −289° F.

The present invention employs a gas phase separator integrated into a subcooler. Further, it removes gas from the gas phase separator, supplies liquid to the subcooler bath, and maintains a liquid level in both the gas phase separator and the subcooler, with one float valve.

The subcooler-separator 11 of the invention is of very compact size, about 16 inches outside diameter ×24 inches high, which enables the user to install the unit on the equipment which uses the subcooled liquid gas.

Liquid level 35 of the separator bath is maintained by the height of the takeoff conduit 37 which feeds into the float valve 23.

When the phase separator container 29 fills to the level of the takeoff conduit 37, the liquid then passes from the separator into the subcooler until the liquid in the subcooler reaches a level 21 which shuts off the float valve 23. Then heat from the coils 47 evaporates some of the liquid in subcooler valve 19 to reduce the level 21 and open the valve 23 to admit the gas from the separator container 29 into the subcooler container 17, since the separator liquid level 35 has dropped because the liquid is passing out of the bottom of the separator container 29 into the coils 47. The separator container 29 then passes gas out until the liquid level 35 reaches the takeoff conduit 37, whereupon liquid passes from the liquid bath 33 of the separator container 29 into the subcooler container 17 until the level 21 of the subcooler bath 19 is high enough to close the valve 23.

In practice, there is a more or less continuous bleed off of gas from separator container 29 because the valve 23 never completely closes and is continuously bleeding off gas and replenishing the liquid in the subcooler bath 19.

When liquid nitrogen is delivered from separator container 29 to the subcooler bath 19, it automatically cools off at ambient pressure to −320° F. Accordingly, as soon as the warm liquid nitrogen at −289° F. is passed through coils 47, the heat from the coils vaporizes the ambient bath to drop the liquid level 21 and open the valve 23 to draw off any gas in separator container 29 and, after the gas has been drawn off, to draw off liquid from separator bath 33 to deliver it to bath 19 and replenish it and bring up its level.

The inventive apparatus provides an automatic system with only one moving part, the float valve. It requires no temperature controls, no solenoid valves, no power supply.

If it is desired to control the outlet temperature of the liquid gas, the subcooler container 17 may be pressurized by pressure regulator 41, and vapor vent 39 closed. For example, for liquid nitrogen, if the pressure in subcooler container 17 is regulated above ambient temperature the temperature of liquid bath 19 becomes warmer than −320° F. On the other hand, if a vacuum is drawn on the ambient bath 19, the temperature of the bath becomes colder than −320° F.

Accordingly, the integrated subcooler-separator of this invention produces absolute liquid with no gas phases, and does so at any desired temperature by selecting the pressure in the subcooler.

I claim:

1. A compact integrated gas phase separator and subcooler for removing gas phases from a liquid gas and subcooling the liquid gas, comprising subcooler means for subcooling a liquid gas, said subcooler means including a subcooler container having a cold bath of liquid gas, gas separator means for removing gas phases from a liquid gas, said separator means including a separator container positioned inside the subcooler container in the cold bath, means for passing a liquid gas from a liquid gas supply line into the phase separator container, heat exchanger means for subcooling the liquid gas including coils extending from the phase separator through the cold bath in the subcooler container, transfer means for passing the gas phases and liquid gas from the separator including a float valve extending from the separator container into the subcooler container with a float floating on the surface of the cold bath in the subcooler, said heat exchanger means also being adapted for opening the float valve by heating the liquid gas in the subcooler bath to evaporate some of it and lower the level of the surface of the subcooler bath, said transfer means also being adapted for closing the float valve by passing liquid gas from the separator container into the subcooler to raise the level of the surface of the subcooler bath.

2. A compact integrated subcooler-gas phase separator unit, for cryogenic fluids such as subcooled liquid nitrogen, which is compact in size to enable the user to install the unit on or near equipment which uses the subcooled nitrogen comprising an outer subcooler container which is vacuum insulated against the passage of heat, a heat exchanger hollow copper coil positioned in the outer container and immersed in an ambient bath of liquid gas, said coil having an upstream end and a downstream end, a gas phase separator container positioned inside the subcooler container and immersed in the ambient bath of liquid nitrogen, a bath of use liquid gas maintained at a selected level in said inner container, the upstream end of the coil emanating from the bottom of said inner container and the downstream end of the coil exiting from the top of the outer container through an outlet tube, a use liquid inlet tube extending through the outer container into the inner container, a vapor vent positioned in the outer container above the level of the ambient bath, float valve means positioned in the outer container for maintaining the level of the liquid in the outer and inner containers, a takeoff tube extending from the selected liquid level of the use bath through the inner container to a float valve inside the outer container, a spout extending from the float valve into the outer container above the ambient bath, a float connected to the valve by an arm, and the float resting on top of the ambient bath, whereby the use liquid to be phase separated and subcooled is delivered through the inlet tube to the use bath in the inner container where it is phase separated and is delivered to the upstream end of the coil and is subcooled in the coil and delivered from the coil through the downstream end of the coil and the outlet tube.

3. A process for removing gas phases from a liquid gas and subcooling the liquid gas, comprising the steps of passing a liquid gas from a supply line into a bath of liquid gas in a gas phase separator container, separating out gas phases and collecting the gas phases in the top portion of the separator container and passing the liquid to the bottom portion of the separator container, subcooling the liquid gas by passing it from the bottom portion of the separator container through heat exchanger coils which extend from the separator container through a colder bath of liquid gas in a subcooler container, delivering the subcooled liquid gas from the heat exchanger coils and the subcooler container to the supply line, passing the gas phases from the separator container into the subcooler container through a float valve, opening the float valve by lowering the level of the liquid gas in the subcooler container by heating the subcooler liquid gas and evaporating some of it, heating and evaporating said subcooler liquid gas by applying heat from the liquid gas being subcooled in the coils, closing the float valve by replenishing the subcooler liquid gas by passing liquid gas into it from the separator container through the float valve, and passing the gas phases out of the subcooler.

4. The process of claim 3, the liquid gas being liquid nitrogen and being passed into the gas phase separator at a temperature of about −289° F. at 60 psi.

5. The process of claim 3, the subcooled liquid gas passing from the subcooler being liquid nitrogen at about −320° F. at 60 psi.

6. A process for subcooling liquid gas and removing gas phases from liquid gas supply lines, comprising the steps of introducing liquid gas into a liquid bath in a gas phase separator, separating the gas phases from the liquid, cooling the liquid by passing it from said separator through heat exchanger coils which are located outside the separator and are submerged in a cold variable-pressure bath within a vacuum insulated subcooler container, said liquid in the heat exchanger heating the liquid bath in the subcooler container to vaporize it and lower the liquid level in the subcooler container, said lowering of the level of the subcooler bath operating to open a float valve to remove gas phases accumulated inside the gas phase separator and to raise the liquid level in the gas phase separator and, after drawing off the gas phases, drawing off liquid to replenish liquid in the subcooler container to raise its liquid level to close the float valve, removing the gas phase from the subcooler through a vent in the subcooler container, and removing the subcooled liquid gas from the heat exchanger and the subcooler container through an exit tube at a desired subcooled temperature and returning it to the supply lines.

7. The process of claim 6, said liquid gas being liquid nitrogen.

8. The process of claim 6, said liquid gas being liquid nitrogen which is introduced to the separator at about −289° F. and 60 psi, and the subcooler bath is liquid nitrogen at a temperature of about −320° F. at 14.7 psi.

* * * * *